United States Patent [19]

Dworak et al.

[11] 4,182,602

[45] Jan. 8, 1980

[54] LEAKAGE PREVENTION MEANS FOR A POSITIVE DISPLACING MACHINE

[75] Inventors: Wilhelm Dworak, Stuttgart; Karl-Heinz Müller, Vaihingen; Wolfgang Talmon, Ötisheim, all of Fed. Rep. of Germany

[73] Assignee: Robert Bosch GmbH, Stuttgart, Fed. Rep. of Germany

[21] Appl. No.: 858,382

[22] Filed: Dec. 7, 1977

[30] Foreign Application Priority Data

Jan. 7, 1977 [DE] Fed. Rep. of Germany ..... 2600381

[51] Int. Cl.[2] ..... F04C 15/00

[52] U.S. Cl. ..... 418/132; 418/149

[58] Field of Search ..... 418/149, 132, 81

[56] References Cited

U.S. PATENT DOCUMENTS

| | | | |
|---|---|---|---|
| 711,239 | 10/1902 | Tree | 418/149 X |
| 3,035,554 | 5/1922 | Selzler | 418/149 X |
| 3,053,191 | 9/1962 | Weigert | 418/149 X |
| 3,473,476 | 10/1969 | Davidson | 418/149 X |

*Primary Examiner*—Leonard E. Smith

*Attorney, Agent, or Firm*—Michael J. Striker

[57] ABSTRACT

A positive displacing machine has a housing having an interior chamber provided with an open end, a cover closing the open end of the chamber, movable working members located in the chamber and in operation producing high pressure in the same, sealing means including an annular groove formed in one of the elements around the open end of the chamber and a sealing member received in the groove, and a further annular groove formed in one of the elements radially outwardly of the first-mentioned groove and communicating with a space which is under pressure lower than the pressure in the interior chamber of the housing. The housing may have two open ends closed by two covers, and the above grooves may be provided in both end portions thereof. The grooves may be formed both in the housing, and in the covers. The further grooves may be open at a circumferential surface of the housing.

13 Claims, 6 Drawing Figures

LEAKAGE PREVENTION MEANS FOR A POSITIVE DISPLACING MACHINE

BACKGROUND OF THE INVENTION

The present invention relates to a positive displacing machine.

Positive displacing machines have been proposed in the art, having a housing whose open end is closed by a cover, and a sealing member located in a groove which communicates with a low pressure zone of an interior chamber of the housing. Such construction possesses the disadvantage that the sealing member is insufficiently loaded, and when the cover of the housing is being variably stressed, working fluid is pressed out, that is, this pressure frequently causes unsealing of the interior chamber of the machine. It is to be understood that such unsealing is extremely undesirable.

SUMMARY OF THE INVENTION

Accordingly, it is an object of the present invention to provide a positive displacing machine which avoids the disadvantages of the prior art.

More particularly, it is an object of the present invention to provide a positive displacing machine in which an interior chamber of the machine is reliably sealed from an exterior space.

In keeping with these objects, and with others which will become apparent hereinafter, one feature of the present invention resides, briefly stated, in that a positive displacing machine, in accordance with the invention, has a housing having an interior chamber with an open end, a cover closing the open end of the housing, movable working elements in the interior chamber of the housing and in operation producing high pressure, sealing means including an annular groove formed in the housing or in the cover around the open end of the housing and a sealing member located in the groove, and a further annular groove formed radially outwardly of the first-mentioned groove and communicating with a space which is under a pressure lower than the pressure in the interior chamber of the housing.

When the displacing machine is constructed as described above, the interior chamber thereof is reliably sealed from the exterior space when the cover of the housing is variably loaded and therefore the working fluid does not come out.

Another feature of the present invention is that the further groove may communicate with the ambient atmosphere.

Still another feature of the present invention is that the further groove may communicate with a low-pressure zone formed in the interior of the chamber of the housing.

A further feature of the present invention is that the further groove may be open at a circumferential surface of the housing of the machine.

A still further feature of the present invention is that the groove may be formed as a flat depression in the housing of the machine.

An additional feature of the present invention is that the groove may be interrupted by bores provided in the housing for receiving threaded members which connect parts of the housing with one another.

A still additional feature of the present invention is that the housing has two open ends closed by two such covers, and the grooves may be formed radially outwardly of both open ends of the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
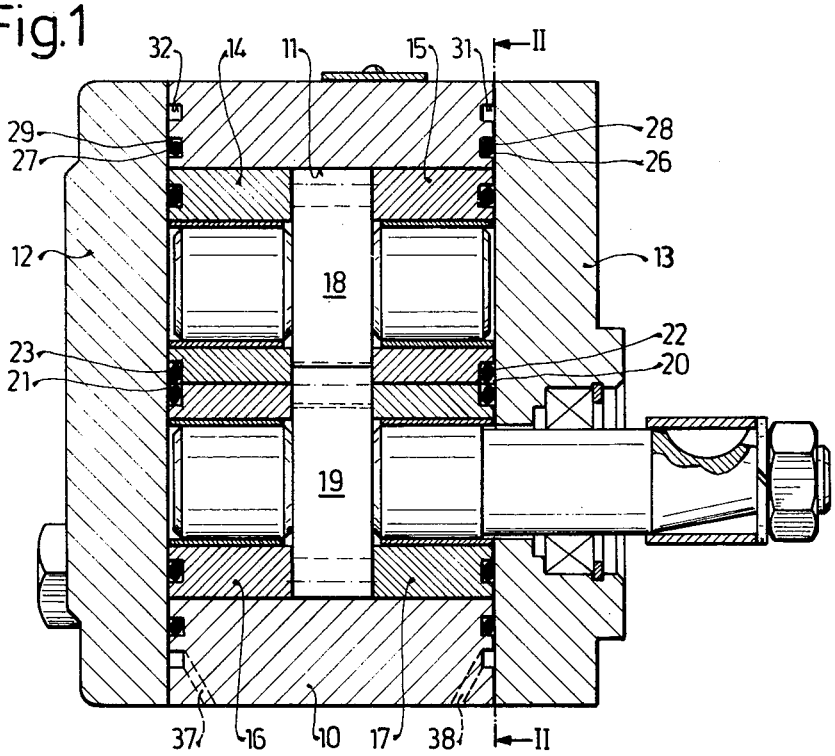
FIG. 1 is a view showing a section of a geared positive displacing machine.

A positive displacement machine, such as a geared pump or a geared motor, is shown in the drawing. The machine has a housing element 10 provided with a through recess 11 whose cross-section has a shape corresponding to the number eight. Both open ends of the recess 11 are closed by cover element 12 and 13. Bushings 14, 15, 16 and 17 are located in the recess 11 and serve as bearing members. Two gears 18 and 19 meshing with one another by their outer teeth are also located in the recess 11 and supported by respective bushings 14–17.

A groove 20 is formed in a side portion of the bushings 15 and 16, which faces towards the cover element 13. The groove 20 has a shape of the number three in a top view thereof and has a rectangular cross-section. A groove 21 identical with the groove 20 is formed in a side portion of the bushings 15 and 17, which face towards the cover element 12. Sealing members 22 and 23 having a shape corresponding to the number three are received into the grooves 20 and 21. Two passages 24 and 25 pass through an interior chamber bounding by the housing element 10, that is they extend into the recess 11 of the latter. The passages 24 and 25 extend in an axial direction, and the passage 24 is a low pressure passage, whereas the passage 25 is a high pressure passage.

Figure 2:
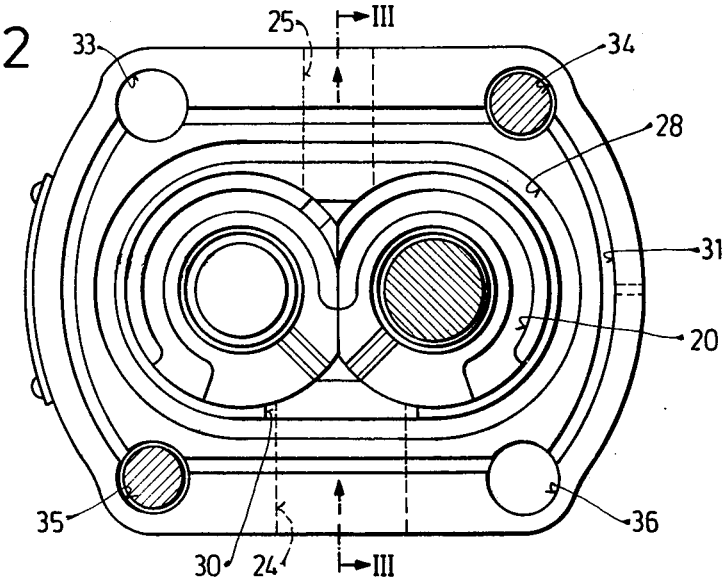
FIG. 2 is a view showing a section of the machine taken along the line II—II in FIG. 1.
Figure 3:
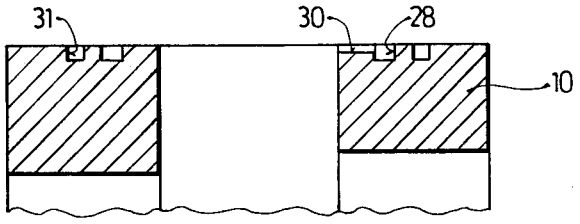
FIG. 3 is a view showing a section of the machine taken along the line III—III in FIG. 2.

It is to be understood that the internal chamber at the housing element 10, that is the recess 11 must be sealed from an exterior space. Such sealing is performed by sealing members 26 and 27 which are received in annular grooves 28 and 29. The groove 28 is formed in the side portion of the housing element 10, which faces towards the cover element 13, wherein the groove 29 is formed in the side portion of the housing element 10, which faces towards the cover element 12. Both grooves 28 and 29 are located radially outwardly relative to the recess 11 of the housing element 10. As shown in FIGS. 2 and 3, the groove 28 communicates with a low pressure zone of the interior chamber of the housing 10 by means of a flat recess 30.

Annular grooves 31 and 32 are further provided in the side portions of the housing element 10 and are radially outwardly spaced from the grooves 28 and 29 for a substantially constant distance. The housing element 10 is connected with the cover elements 12 and 13 by bolts extending through bores 33, 34, 35 and 36. As can be seen from FIG. 2 the grooves 31 and 32 are interrupted by the bores 33–36. It is to be understood that the bores 33–36 may also be so located in another embodiment of the present invention that the grooves 31 and 32 are not interrupted by the same. Bores 37 and 38 are further provided, which extend from the grooves 31 and 32 up to an outer surface of the housing element 10. Instead of the above bores, grooves may be formed in the side portions of the housing element 10.

In operation, parts of the displacing machine are subjected to the action of a high pressure which acts, first of all, upon the cover elements 12 and 13. The cover element tends to deflect particularly under the action of deflecting torque applied to the bolts, so that the machine may be essentially unsealed. Thereby, the high pressure which is in the interior of the machine acts upon the sealing members 26 and 27. But even though a main pressure of the machine is not applied to the sealing members, some leakage of the working fluid during a certain time cannot be prevented. The above occurs for the reason that under the action of a variable force applied to the cover elements during loading and unloading of the machine a pressure process is generated so that the working fluid can flow through the sealing members 26 and 27 towards the exterior of the machine.

Since the grooves 31 and 32 are provided, the deflection of the covers does not cause flowing of the working fluid out of the machine, but instead air is sucked in from outside. Thus, during the above-mentioned pressure process only additional air moves inwardly and outwardly, whereas the working fluid does not flow out. The sealing members 26 and 27 are relieved by means of communication with the low pressure zone of the machine through the flat recess 30.

Attention is directed to FIG. 1, in particular to the annular interface where the axial face of cover 12 and the axial face of housing element 10 engage each other. When the machine is in loaded condition, the pressure built up within it causes the cover 12 to axially bulge, to some degree, the axial bulging of cover 12 being greatest at its radially innermost or central portion and being smallest at its outer periphery. As a result, there is a tendency for the plane-parallel space between the engaging axial faces of cover 12 and housing element 10 to enlarge and assume the shape of a wedge whose vertex is at the outermost edges of these elements, the pressure within such opened-up wedge-shaped intermediate space being subatmospheric, and the axial faces of elements 12 and 10 remaining in engagement at their outermost edges as a result of which the subatmsopheric pressure thusly generated at the interface zone is not relieved to the ambient atmosphere. As a consequence, pressure fluid within the machine tends positively to be sucked into the opened-up wedge-shaped space, i.e., moving into such space radially outward of the sealing ring 27 or 26, but not escaping to the exterior of the machine at this time, because of the tight engagement between elements 12 and 10 at their outermost edges. Then, when the machine becomes unloaded, the opened-up wedge-shaped space intermediate elements 10 and 12 (or 10 and 13) closes in again, i.e., returns to a condition of plane-parallel shape and extremely small axial length, namely as the axial faces of elements 12 and 11 again come back into face-to-face engagement with each other. In the prior art, this tends to positively expel the hydraulic medium which has previously entered into such wedge-shaped space when the pump was in loaded condition, and such medium is positively expelled to the exterior of the machine, imparting to the exterior of the machine a generally oily condition. In contrast, in accordance with the present invention, the provision of the annular groove 32 or 31 radially outward of sealing ring 27 or 28 serves to maintain the interface region radially outwards of the sealing ring at atmospheric pressure. Accordingly, when the interface space opens up and assumes a wedge-like shape (as seen in cross-section) during the loaded condition of the machine, the wedge-like space is now at substantially atmospheric pressure, not at considerably subatmospheric pressure. This reduces the tendency of the pressurized oil in the interior of the machine to migrate radially outwards beyond sealing ring 27 or 28 into such interface region, and thereby very greatly reduces the amount of hydraulic medium, if any, positively expelled to the exterior of the machine when the machine returns to an unloaded condition. Furthermore, as the interface space opens up to assume a wedge-like shape, the increase in its volume preferentially causes it to become filled with sucked-in ambient air, not sucked-out internal pressure fluid. As a result, hydraulic machines embodying this concept exhibit a much less oily and indeed substantially non-oily character at their external surfaces.

Figure 5:
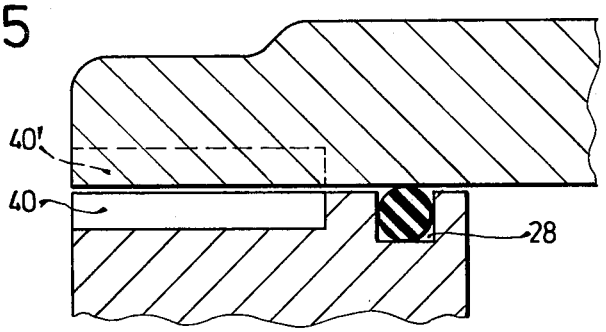
FIG. 5 is a view showing a section of fragments of a housing and a cover of a positive displacing machine in accordance with still another embodiment of the present invention.
Figure 6:
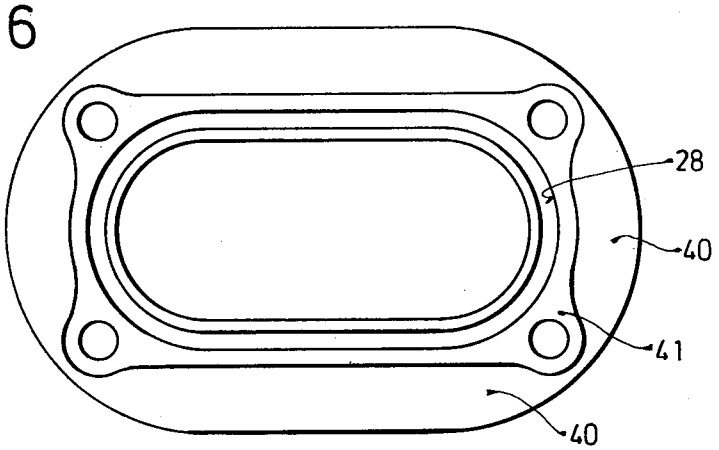
FIG. 6 is a top view of the housing shown in FIG. 5.

FIGS. 5 and 6 show another embodiment of the present invention in which the same results are attained. In the machine in accordance with this embodiment the grooves 31 and 32 radially outwardly surrounding the grooves 28 and 29 are not provided. Instead of the grooves 31 and 32, a flat recess 40 is formed in the housing element 10 and extends from the region adjacent to the groove 28 and up to the circumferential surface of the housing element 10. The recess 40 passes over the entire circumferential surface of the housing element 10.

It is to be understood that the grooves 28 and 29 for the sealing members 26 and 27, as well as the grooves 31 and 32 may also be formed in the cover elements 12 and 13. The same is also true with respect to the recess 40. As shown in dotted lines in FIG. 5, a groove 40' may be formed in the cover element. It is also possible to form one of the grooves in the housing element 10, whereas the other groove may be formed in a respective one of the cover elements 12 and 13.

Figure 4:
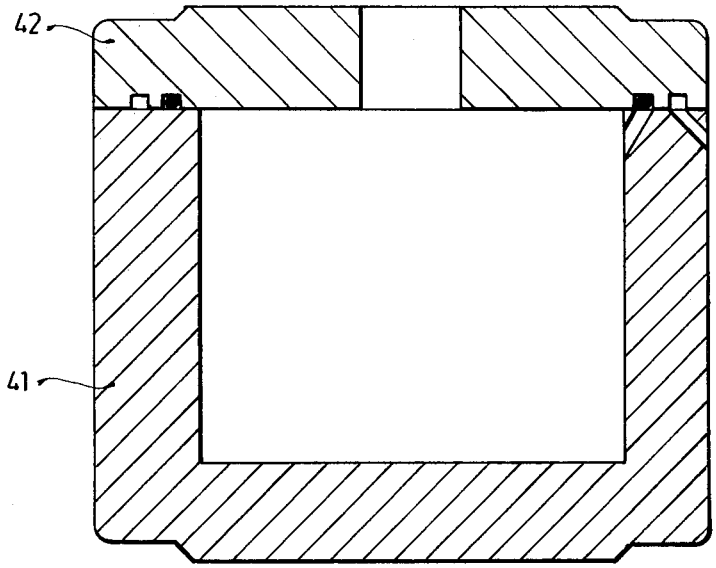
FIG. 4 is a view showing a section of a housing of a positive displacing machine in accordance with another embodiment of the present invention.

As shown in FIG. 4, a housing element which is identified here with reference numeral 41, may be cup-shaped. In this case only one cover element 42 is required for closing the housing element 41.

It is to be understood that the above features may be provided not only in geared displacing machines, but also in displacing machines of other types, such as in vane-type pumps.

It will be understood that each of the elements described above, or two or more together, may also find a useful application in other types of constructions differing from the types described above.

While the invention has been illustrated and described as embodied in a displacing machine, it is not intended to be limited to the details shown, since various modifications and structural changes may be made without departing in any way from the spirit of the present invention.

Without further analysis, the foregoing will so fully reveal the fist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A positive displacement machine, comprising a housing element having an interior chamber provided with an open end; a cover element closing said open end of said interior chamber and immovably connected with said housing element; movable working members in said interior chamber and in operation producing high pressure in the same; sealing means including an annular groove formed in at least one of said elements and surrounding said open end of said interior chamber, and a sealing member located in said groove for sealing said interior chamber of said housing element, and a further unobstructed annular groove formed in at least one of said immovable elements radially outwardly of said first-mentioned groove at a distance and separate from the latter, said further annular groove communicating with an air space which is under a pressure lower than the pressure in said interior chamber of said housing element so that, during the operation of the machine only air moves inwardly and outwardly of said further annular groove but a working fluid cannot flow out of the machine past the latter.

2. The machine as defined in claim 1, wherein said further groove communicates with the ambient atmosphere.

3. The machine as defined in claim 1, wherein said further groove is formed in said housing element.

4. The machine as defined in claim 1, wherein said further groove is formed in said cover element.

5. The machine as defined in claim 1, wherein one of said grooves is formed in one of said elements, whereas the other groove is formed in the other element.

6. The machine as defined in claim 1; and further comprising a threaded member for connecting said elements with one another, one of said elements in which said further groove is provided having an opening for inserting said threaded member therein and interrupting said further groove.

7. The machine as defined in claim 1, wherein said movable working members in operation produce a pressure, in a zone of said interior chamber, which is lower than the high pressure produced by the same, said first-mentioned groove of said sealing means communicating with said lower pressure zone.

8. The machine as defined in claim 1; and further comprising threaded members connecting said elements with one another, one of said elements having a flat side surface, and a raised flange for extending said threaded members therethrough and raised relative to said flat surface, said depression being formed between said flat side surface and said raised flange.

9. The machine as defined in claim 1, wherein said housing element has a side portion, said further groove being formed in one of said side portions of said housing element.

10. The machine as defined in claim 9, wherein said housing element has another side portion spaced from said first-mentioned side portion, said housing element having a second open end formed in the other side portion thereof; and further comprising a second such cover element closing said second open end of said housing; and further comprising second such sealing means including a second such annular groove surrounding said second open end of said housing element and a second sealing member located in said second groove, one of said elements having a second such further annular groove radially outwardly of said first-mentioned second groove.

11. The machine as defined in claim 1, wherein said housing element and said cover element have circumferential surfaces, said further groove being formed as a depression which is open at and extending over the entire circumferential surface of a respective one of said elements.

12. The machine as defined in claim 11, wherein said first-mentioned groove and said depression are formed in said housing element.

13. The machine as defined in claim 11, wherein said depression is formed in said cover element.

* * * * *